US006547516B2

(12) United States Patent
Liu

(10) Patent No.: US 6,547,516 B2
(45) Date of Patent: Apr. 15, 2003

(54) FAN BRACKET

(75) Inventor: Yung Chuan Liu, Walnut, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 2 days.

(21) Appl. No.: 09/934,147

(22) Filed: Aug. 21, 2001

(65) Prior Publication Data

US 2003/0039546 A1 Feb. 27, 2003

(51) Int. Cl.[7] ..... F04D 29/64
(52) U.S. Cl. ..... 415/108; 415/213.1; 415/214.1
(58) Field of Search ..... 415/108, 213.1, 415/214.1; 416/244 R; 361/697; 165/80.3, 104.33, 121

(56) References Cited

U.S. PATENT DOCUMENTS 4,717,024 A * 1/1988 Djezovic ..... 206/581
5,495,389 A * 2/1996 Dewitt et al. ..... 361/683
5,701,231 A * 12/1997 Do et al. ..... 361/683
5,955,955 A * 9/1999 Corcoran, Jr. et al. ..... 340/607
6,104,607 A * 8/2000 Behl ..... 361/687
6,109,340 A * 8/2000 Nakase et al. ..... 165/80.3
6,404,633 B1 * 6/2002 Hsu ..... 361/703

* cited by examiner

*Primary Examiner*—Ninh Nguyen
(74) *Attorney, Agent, or Firm*—WeiTe Chung

(57) ABSTRACT

A bracket includes a housing and a cover attached to the housing. The housing includes a base and first and second side walls extending from opposite sides of the base. The base forms a number of first sills to define a receiving space for engagingly receiving a fan therein. The first side wall forms a pair of first tabs. The second side wall forms a secure plate. The cover forms a pair of second tabs pivotablly attached to the first tabs of the first side wall. A latching plate extends from the cover opposite the second tabs for engaging with the secure plate of the second side wall.

18 Claims, 5 Drawing Sheets

FAN BRACKET

BACKGROUND OF THE INVENTION

1. Field of the Invention

The present invention relates to a bracket, particularly to a bracket easily receiving a fan therein.

2. The Related Art

Heat dissipation devices are used in many systems which generate heat for keeping the system working within a range of normal working temperature. A heat dissipation device may be a fan, a heat pipe, a heat sink or a combination thereof. Whatever it is, it is often required to conveniently assembling the heat dissipation device to the system.

A fan, as a heat dissipation device, is often used in a personal computer, a workstation, a router or a server for heat dissipation. Usually, the fan is directly attached to a heat sink or an enclosure by screws. However, it is complicated to attach or detach the fan. Especially in some occasions, it is required to assemble the fan to a bracket to be a subassembly and then assemble the subassembly to a system such as a server or a router, for easily assembling the fan to the system. It is important to make the assembling process easy in mass production, for it can save so much working time that cost is reduced. Thus, a bracket which can readily receive fan therein is required.

SUMMARY OF THE INVENTION

Accordingly, the present invention provides a bracket defining a receiving space for readily receiving a fan therein.

For achieving the above mentioned object, a bracket of the present invention includes a housing and a cover attached to the housing. The housing includes a base and first and second side walls extending from opposite sides of the base. The base forms a plurality of first sills to define a receiving space adapted for engagingly receiving a fan therein. The first side wall forms a pair of first tabs. The second side wall forms a secure plate. The cover forms a pair of second tabs pivotably attached to the first tabs of the first side wall. A latching plate extends from the cover opposite the second tabs for engaging with the secure plate of the second side wall.

Other objects can be drawn from the detailed description of the preferred embodiment of the present invention with the attached drawings, in which:

DETAILED DESCRIPTION OF THE PREFERRED EMBODIMENT

Generally referring to the attaching drawings, a bracket 2 of the present invention includes a housing 4 and a cover 6 attached to the housing 4. The bracket 2 is designed to receive a fan 8 therein in the preferred embodiment. Of cause, such bracket 2 can be used to receive other device such as a hard disk drive or a compact disk read-only memory drive instead of the fan 8. Furthermore, a printed circuit board (PCB) 10 can be secured in the bracket 2.

Figure 1:
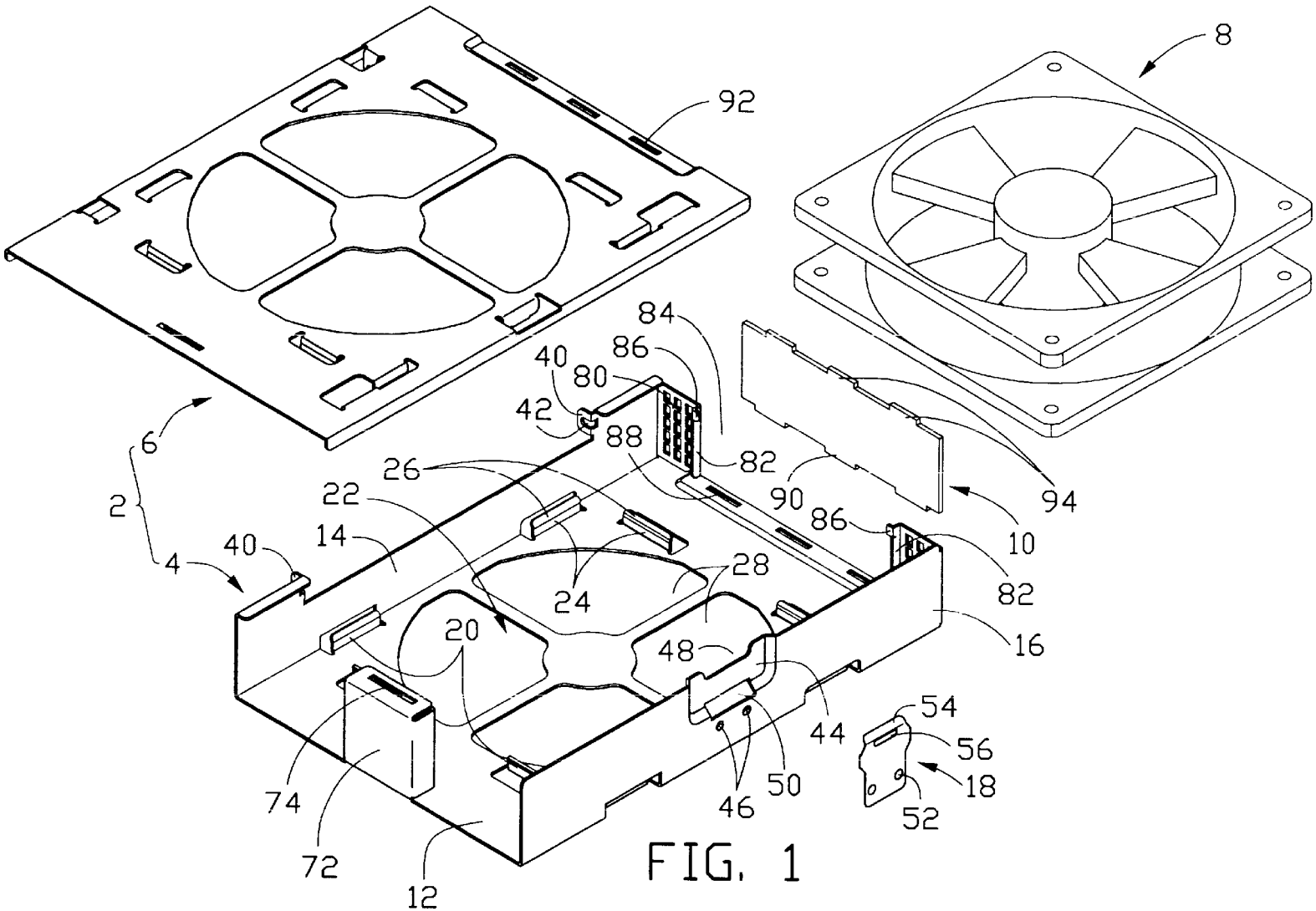
FIG. 1 is an exploded view of a bracket of the present invention, a fan and a PCB.

Referring to FIG. 1, the housing 4 includes a base 12 for supporting the fan 8, first and second side walls 14, 16 extending from opposite sides of the base 12, and a secure plate 18 attached to the second side wall 16. The base 12 stampingly forms four pairs of first sills 20 to define a first rectangular receiving space 22 for receiving the fan 8. Each first sill 20 has a first engaging portion 24 extending from the base 12 for abutting against the fan 8 and a first guiding portion 26 outwardly extending from the first engaging portion 24 for guiding the fan 8 to engage with the first engaging portion 24. Four first vents 28 are defined in the base 12 in communication to the first receiving space 22.

Figure 2:
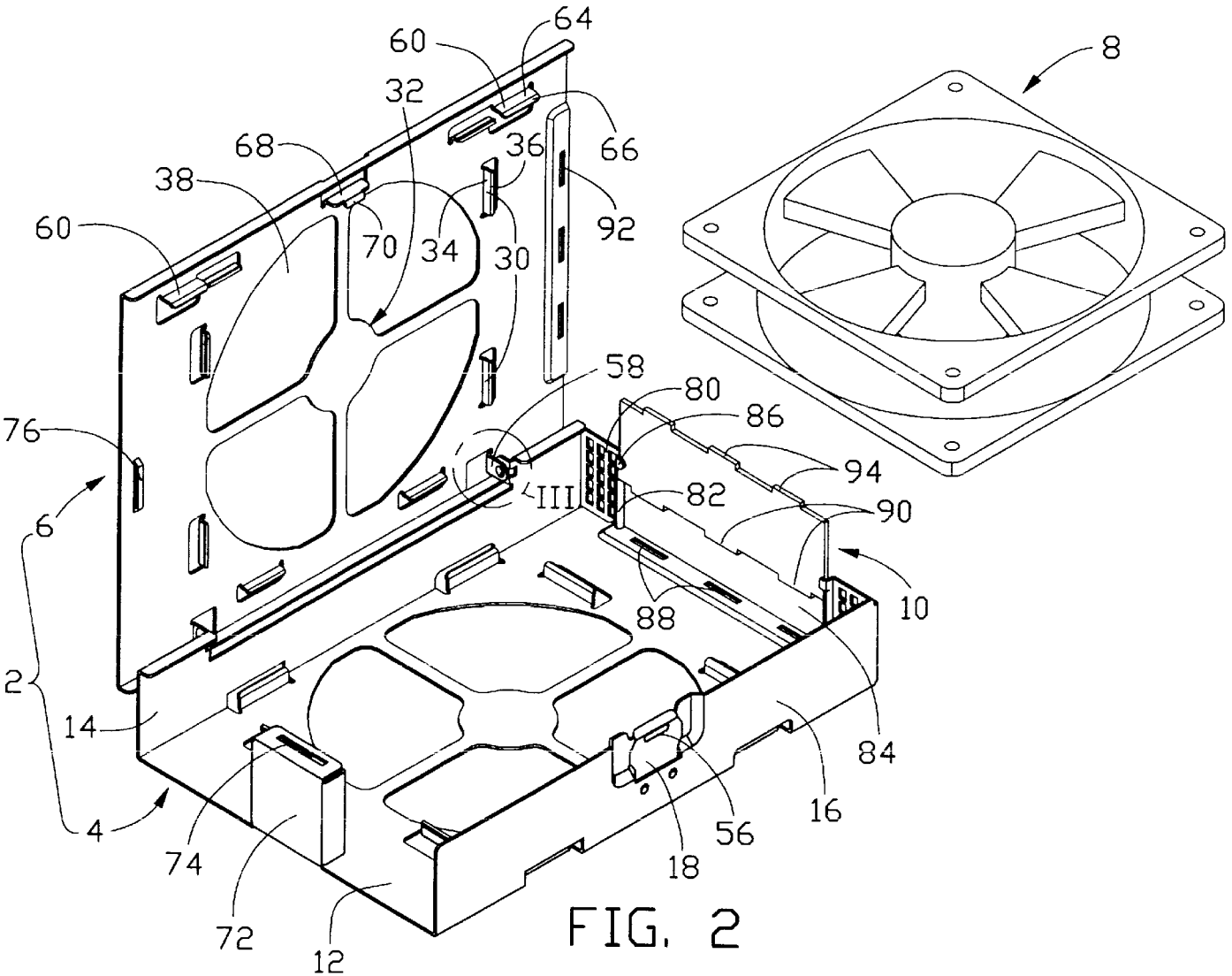
FIG. 2 is a partially assembled view of FIG. 1.

Referring to FIG. 2, the cover 6 stampingly forms four pairs of second sills 30 to define a second rectangular receiving space 32 for receiving the fan 8. Each second sill 30 has a second engaging portion 34 extending from the cover 6 for abutting against the fan 8 and a second guiding portion 36 outwardly extending from the second engaging portion 34 for guiding the fan 8 to engage with the second engaging portion 34. Four second vents 38 are defined in the cover 6 in communication to the second receiving space 32.

Figure 4:
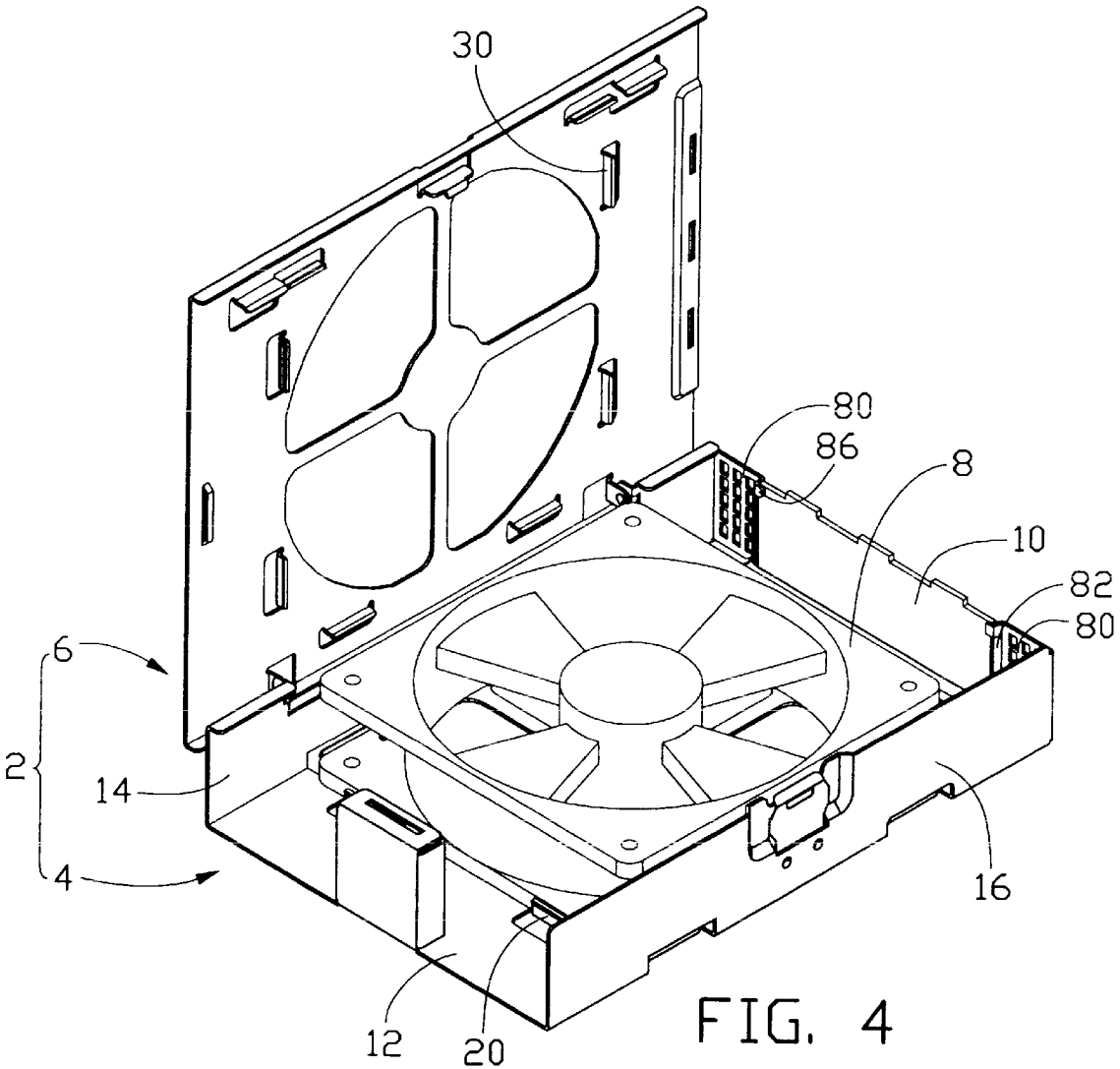
FIG. 4 is another partially assembled view of FIG. 1.
Figure 5:
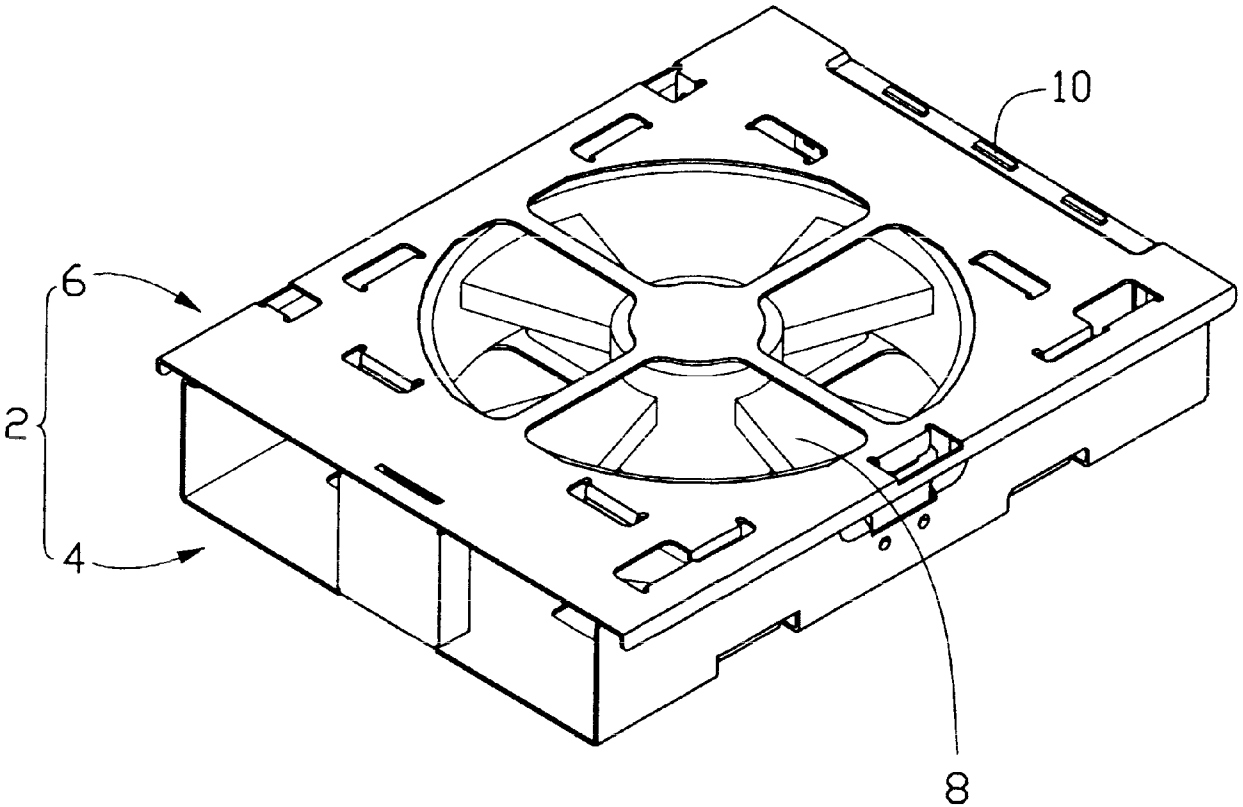
FIG. 5 is an assembled view of FIG. 1.

Also referring to FIGS. 4 and 5, in assembly, the fan 8 is received in the first receiving space 22 and engages with the first sills 20 of the housing 4. The cover 6 is attached to the housing 4 for abutting against the fan 8 and receives the fan 8 in the second receiving space 32 with the second sills 30 engaging with the fan 8. Thus, the fan 8 is readily assembled to the bracket 2 without any screws which are required in the prior art.

The bracket 2 of the present invention also has another advantage that the cover 6 is conveniently attached to the housing 4. Referring to FIG. 1, the first side wall 14 of the housing 4 stampingly forms a pair of first tabs 40 outwardly extending therefrom. Each first tab 40 defines one section of a slot 42 which has the other section defined in the first side wall 14. The second side wall 16 stampingly and inwardly forms a recessed portion 44 and two protrusions 46 adjacently below the recessed portion 44. The recessed portion 44 defines a cutout 48 at a top section thereof and a groove 50 at a bottom section thereof for extension of the secure plate 18. The secure plate 18 defines two apertures 52 for engaging with the two protrusions 46 thereby attaching the secure plate 18 to the second side wall 16. A leading lip 54 is stampingly formed at a top section of the secure plate 18. A mouth 56 is defined in the secure plate 18 adjacently below the leading lip 54.

Figure 3:
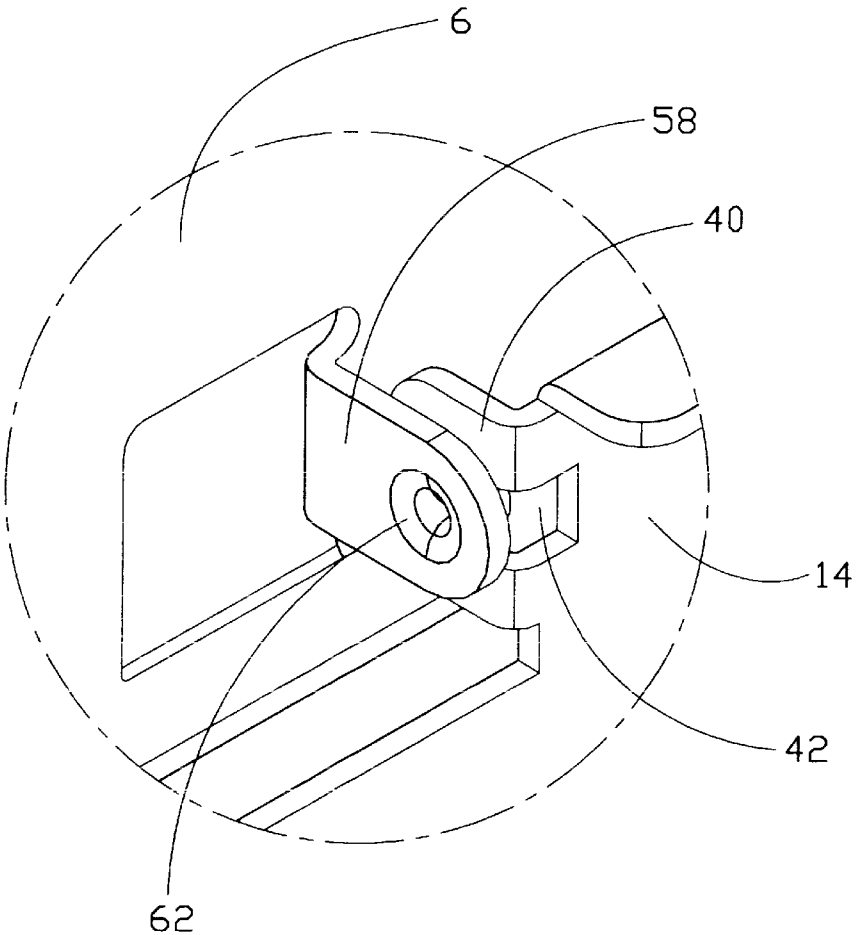
FIG. 3 is an enlarged view of circled portion III of FIG. 2.

Referring to FIGS. 2 and 3, the cover 6 stampingly forms a pair of second tabs 58 and a pair of fingers 60 opposite the second tabs 58. Each second tab 58 stampingly forms a pivot 62 for extending into and being pivotably received in the slot 42 in the first tab 40. Thus, the cover 6 is pivotable about the housing 4 via the first and second tabs 40, 58. Each finger 60 has an abutting section 64 extending from the cover 6 for abutting against an inner surface of the second side wall 16 and a leading section 66 extending from the abutting section 64. A latching plate 68 is stampingly formed at the cover 6 between the fingers 60. The latching plate 68 stampingly forms a tongue 70 for extending into the mouth 56 of the secure plate 18 thereby limiting movement of the latching plate 68. Thus, as shown in FIGS. 4 and 5, the cover 6 is readily attached to the housing 4.

Referring to FIG. 2, a support 72 is stampingly formed at the base 12 of the housing 4. The support 72 defines a slit 74 extending from a top surface thereof. A beam 76 extends from the cover 6 for matingly extending into the slit 74, thereby enhancing the attachment of the cover 6 and the housing 4.

Referring to FIGS. 1 and 2, furthermore, the bracket 2 of the present invention is designed to receive the printed circuit board (PCB) 10 therein. The housing 4 has an end wall 80 connected between the side walls 14, 16 and opposite the support 72. The end wall 80 stampingly forms a pair of flanges 82 and defines an opening 84 between the flanges 82. Each flange 82 forms a toe 86 for abutting against the PCB 10. The base 12 defines three first elongate holes 88 between the flanges 82 for receiving corresponding first projecting portions 90 of the PCB 10. The cover 6 defines three second elongate holes 92 for receiving corresponding second projecting portions 94 of the PCB 10.

Also referring to FIGS. 4 and 5, in assembly, the PCB 10 is received in the opening 84 of the end wall 80. The base 12, the cover 6, the flanges 82 and the toes 86 abut the PCB 10. The first and second projecting portions 90, 94 of the PCB 10 are received in the first and second elongate holes 88, 92. Thus, the PCB 10 is readily secured in the bracket 2.

The present invention can be varied in different embodiments. The above preferred embodiment is just to illustrate the present invention but not limit the scope of claims of the present invention.

What is claimed is:

1. A bracket comprising:

a housing forming a plurality of first sills to define a receiving space adapted for engagingly receiving a fan therein;

a cover attached to the housing adapted for abutting against the fan;

wherein the housing comprises a base and a first side wall extending from the base, the first side wall forming a pair of first tabs, wherein the cover forms a pair of second tab pivotably attached to the first tabs of the housing;

wherein a second side wall extends from the base opposite the first side wall and has a secure plate, and wherein the cover forms a latching plate engaging with the secure plate; and wherein the second side wall forms at least one protrusion, the secure plate defines at least one aperture engagingly receiving the at least one protrusion of the second side wall, and wherein the second side wall forms a recessed portion defining a groove for extension of the secure plate.

2. The bracket as described in claim 1, wherein each of the first tabs define one section of a slot of which the other section is defined in the first side wall, and wherein each second tab forms a pivot pivotably extending into the slot in corresponding first tab.

3. The bracket as described in claim 1, wherein the secure plate defines a mouth therein, and the latching plate forms a tongue engagingly received in the mouth.

4. The bracket as described in claim 3, wherein the secure plate forms a leading lip adjacent to the mouth for guiding the latching plate to extend into the mouth.

5. The bracket as described in claim 1, wherein each first sill comprises an engaging portion and a guiding portion extending from the engaging portion.

6. The bracket as described in claim 1, wherein the cover forms a plurality of second sills adapted to engage with the fan.

7. The bracket as described in claim 1, wherein the housing forms a support defining a slit, and wherein the cover forms a beam matingly received in the slit.

8. The bracket as described in claim 1, wherein the housing defines a plurality of first elongate holes adapted for receiving corresponding first projecting portions of a printed circuit board, wherein the cover defines a plurality of second elongate holes adapted for receiving corresponding second projecting portions of the printed circuit board, and wherein the housing comprises an end wall forming a pair of flanges adapted for abutting against the PCB, each flange forming a toe adapted for abutting against the printed circuit board.

9. The bracket as described in claim 1, wherein the cover forms a pair of fingers abutting against the housing, each finger having an abutting section and a leading section extending from the abutting section.

10. A bracket and a fan comprising:

a fan;

a housing comprising a base, a first side wall extending from a side of the base, and a second side wall opposite to the second side wall, the base defining a receiving space receiving the fan therein and a plurality of first vents in communication to the receiving space; and a cover pivotably attached to the first side wall and engaging with the second side wall, the cover defining a plurality of second vents;

wherein the base forms a plurality of sills to define the receiving space, each of the sills comprises an engaging portion engaging the fan and a guiding portion extending from the engaging portion.

11. The bracket as described in claim 10, wherein the first side wall forms a pair of first tabs, and the cover forms a pair of second tabs pivotably attached to the first tabs.

12. The bracket as described in claim 10, wherein the sills define the receiving space being substantially rectangular.

13. The bracket as described in claim 10, wherein the cover forms a pair of fingers abutting against the second side wall of the housing, each finger having a abutting section and a leading section extending from the abutting.

14. The bracket as described in claim 10, wherein the second side wall has a secure plate, and wherein the cover forms a latching plate engaging with the secure plate.

15. A bracket comprising:

a housing comprising a base, a first side wall extending from a side of the base and a second side wall opposite to the first side wall, the base defining a receiving space, the first side wall forming a pair of first tabs, the second side wall having a secure plate; and a cover comprising a pair of second tabs pivotably attached to the first tabs of the first side wall and a latching plate engaged with the secure plate of the second side wall;

wherein the base forms a plurality of sills to define the receiving space, each of the sills comprising an engaging portion and a guiding portion extending from the engaging portion.

16. The bracket as described in claim 15, wherein the sills of the base define the receiving space being substantially rectangular.

17. The bracket as described in claim 15, wherein the cover forms a pair of fingers opposite the second tabs for abutting against the second side wall of the housing, each finger having a abutting section and a leading section extending from the abutting.

18. A bracket comprising:

a housing forming a plurality of first sills to define a receiving space adapted for engagingly receiving a fan therein; and a cover attached to the housing adapted for abutting against the fan, wherein the housing forms a support defining a slit, and wherein the cover forms a beam matingly received in the slit.

* * * * *